United States Patent [19]

Edlund

[11] Patent Number: 4,920,650

[45] Date of Patent: May 1, 1990

[54] TENSION ARRANGEMENT

[75] Inventor: Dag H. Edlund, Huskvarna, Sweden

[73] Assignee: Aktiebolaget Electrolux, Stockholm, Sweden

[21] Appl. No.: 315,727

[22] Filed: Feb. 24, 1989

[30] Foreign Application Priority Data

Mar. 4, 1988 [SE] Sweden ..... 8800793

[51] Int. Cl.[5] ..... B27B 17/00

[52] U.S. Cl. ..... 30/386; 83/816; 411/378

[58] Field of Search ..... 30/386, 387, 385, 384, 30/384, 122, 500; 83/816, 817; 254/199; 411/378, 271, 190

[56] References Cited

U.S. PATENT DOCUMENTS

| | | | |
|---|---|---|---|
| 780,951 | 1/1905 | Kulhanek | 411/378 |
| 1,413,818 | 4/1922 | Wilkinson | 411/378 |
| 3,337,925 | 8/1967 | Meyer | 411/378 |
| 3,866,320 | 2/1975 | Progl | 83/816 |
| 4,316,327 | 2/1982 | Scott et al. . | |
| 4,382,334 | 5/1983 | Reynolds | 30/386 |
| 4,567,658 | 2/1986 | Wissmann et al. . | |

FOREIGN PATENT DOCUMENTS

| | | | |
|---|---|---|---|
| 3742121 | 6/1988 | Fed. Rep. of Germany | 30/386 |
| 448536 | 2/1913 | France | 254/199 |
| 2042974 | 10/1980 | United Kingdom | 30/386 |

*Primary Examiner*—Douglas D. Watts
*Assistant Examiner*—Paul M. Heyrana
*Attorney, Agent, or Firm*—Pearne, Gordon, McCoy & Granger

[57] ABSTRACT

A chain tension arrangement of a chain saw having a freely displaceable pin (19) in the saw body introduced into suitable hole (21) in the sword (15) and a tension screw (24) in the cover (10) which covers the centrifugal clutch and is included into the attachment of the sword. For the chain tension moment no presetting of the chain tightening arrangement is required. Owing to the shape of the parts those ones get engaged with each other when fitting the cover. Then the chain tightening is effected with a set screw (25) in the cover by means of a simple hand grip and, after that, the sword attachment is tightened.

5 Claims, 2 Drawing Sheets

TENSION ARRANGEMENT

The present invention relates to a tension arrangement at the saw sword of a chain saw in which the chain of the sword shall be adjusted to a suitable tension.

A known arrangement for adjusting the saw chain is described in e.g. the Swedish Patent Publication No. SE-A-8800626-7 in which a tension screw is inserted in the saw body close to the saw sword and provided with a dog which projects into a hole of the sword. In this place there is only a small space for turning the screw so that adjustment can be effected and this causes irritation and waste of time. The American Patent Publication US-P-3,866,320 describes an arrangement where the screw is located in the clutch cover and an angular gear is arranged for turning the screw via a pivot pin in the cover. This arrangement has also a drawback in that the dog on the tension screw is now located in the cover and thus invisible when it shall be put into the corresponding hole in the sword when mounting the cover. It is consequently necessary to put the dog in the correct position which takes a long time, especially if it has to be moved from one end position to the other.

The purpose of the invention is to mke a simple tension arrangement eliminating the said disadvantages of such arrangements in the technical field concerned. A freely displaceable pin is arranged in the saw body, to which pin the sword with the mentioned hole is applied when it is mounted on the saw body. The clutch cover, constituting part of the sword attachment and initially placed loosely on the sword bolts, includes a tension screw co-operating with the said pin. When applying the cover no presetting of the parts is required, as these ones are automatically adjusted to one another. The adjusting member for turning the tension screw is located in the cover and is easily accessible with tools so that a position adjustment of the sword and tension of the chain are simplified. After adjustment the sword is secured by means of the sword bolts. The properties of the arrangement according to the invention are, moreover, defined in the characteristics of claim 1.

Figure 1:
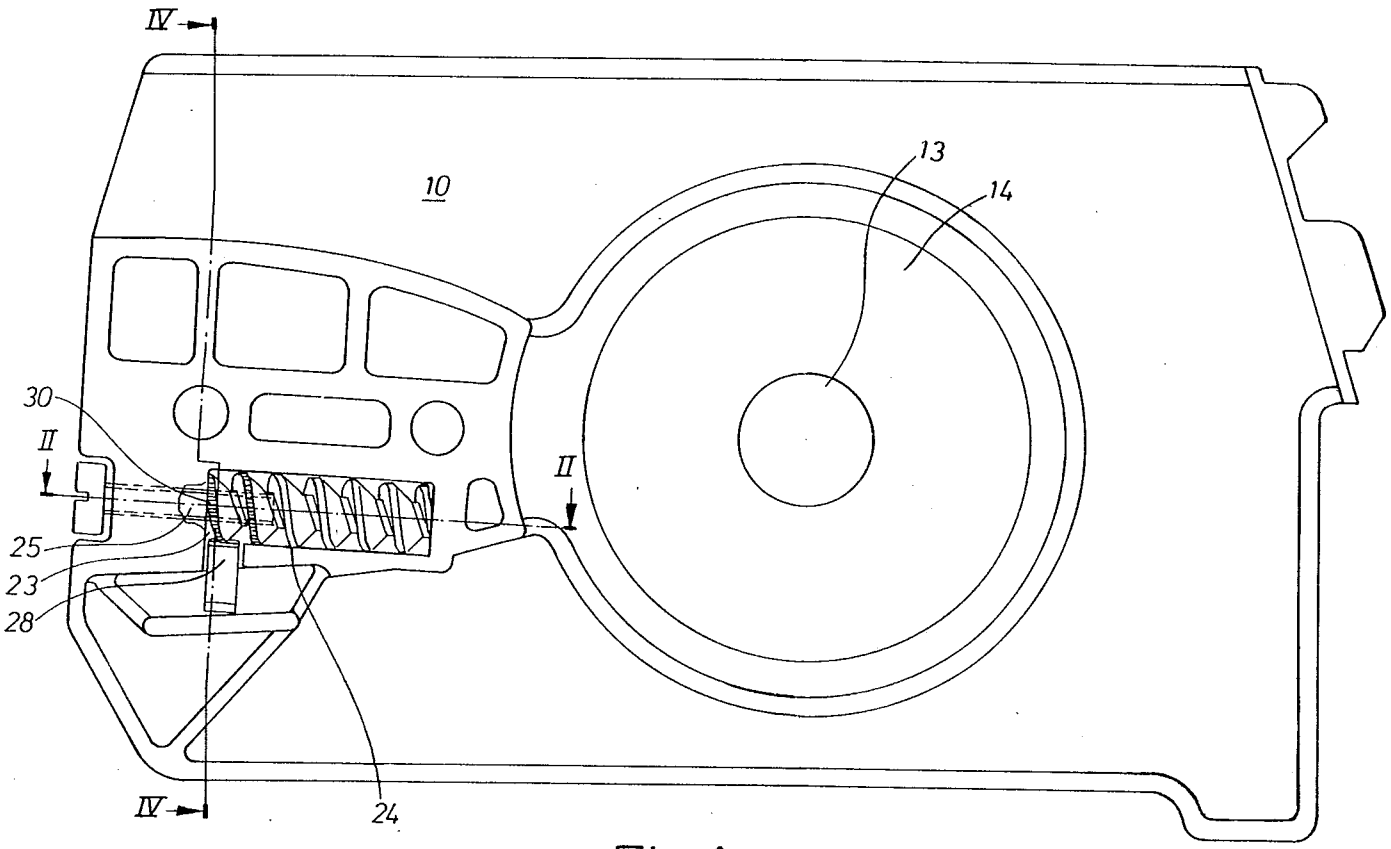
Figure 2:
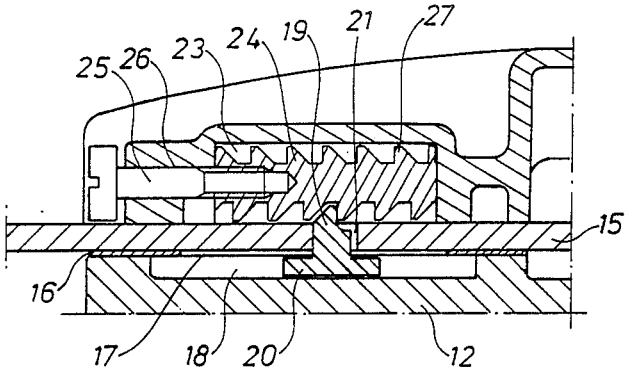

An embodiment of the arrangement according to the invention is described in the following with reference to the drawings attached which show in FIG. 1 the interior of a clutch cover of a chain saw, FIG. 2 is a cross section along the line II—II in FIG. 1, FIG. 3 a variation of the arrangement in the same cross section, FIG. 4 a cross section along the line IV—IV in FIG. 1.

A clutch cover 10 of the chain saw constitutes one half of the sword attachment and is, after fitting, kept in place by sword bolts 11 projecting from the saw body 12. An engine shaft 13 with a clutch drum 14 is schematically shown as circles in the location they have when fitting the cover. Between the cover and the saw body a sword 15 is fastened by means of the bolts as shown in FIG. 4. Next to the saw body parallell to the sword a protective plate 16 has been inserted in which a groove 17 is made. The latter coincides with a cavity 18 in the saw body where there is enough space for a displaceable pin 19 with a foot 20. The foot is recessed in the cavity and moveable in it but prevented from leaving it owing to the protective plate. The end of the pin is somewhat tapered and projects into a hole 21 of the sword which in that way is fixed to the pin. The sword has also oblong holes 22 penetrated by the sword bolts, so it can be pushed on the said bolts.

The clutch cover has also holes and cavities including details for the tension arrangement. In one of those details 23 there is a rough threaded tension screw 24, journalled in bearings, and rotatable by means of a setting screw 25 inserted in a hole 26. There are different variations of the screw, such as slotted screw (FIG. 2), hexagon screw (FIG. 3) etc. The rough threads 27 of the tension screw has a profile harmonizing with the tapered end of the pin 19 which projects into the thread when the cover is fitted. In that way the pin becomes a dog on the screw 24 which thus moves the pin in the groove 17 when rotating. The sword, which is loosely supported in the attachment during the setting, follows the movement of the pin. When putting on or off the cover, the pin is engaged or disengaged with the screw without intervention by the operator. As a supplement to the tension screw a stop spring 28 has been arranged, bent over a cam 29 and fixed inside the cover. Its end is dragging against one end 30 of the thread, the periphery of which is toothed in order to give friction against the spring. By means of this stop spring a possible self-rotation of the tension screw is counter acted.

Figure 3:
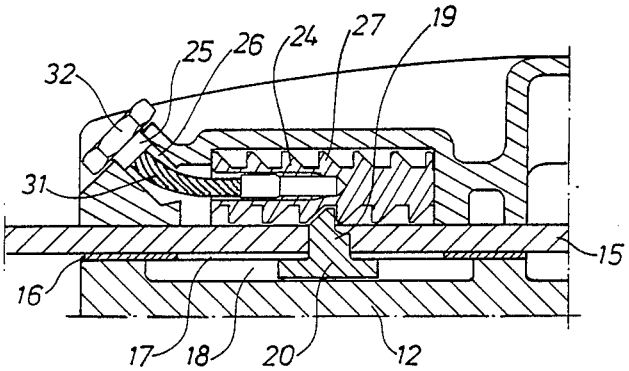
Figure 4:
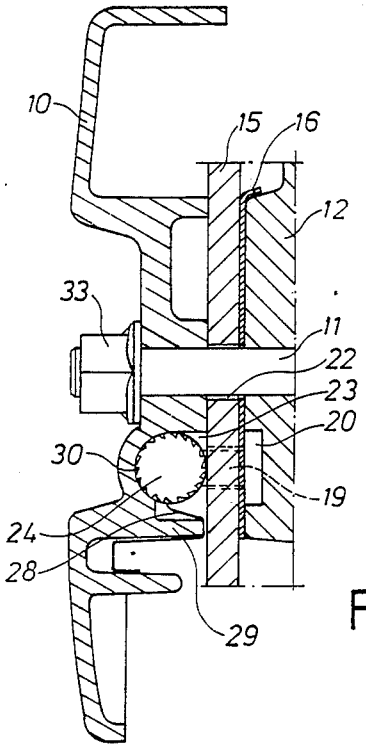

In FIG. 3 a variation of the setting screw 25 is shown as a flexible shaft 31 which has a hexagon head 32 in the outer end. This has preferably the same size as the nuts 33 on the sword bolts and, consequently, the same torque wrench fits on all screw places of the sword attachment. Furthermore, the shaft 31 is bent out from the sword so that the accessability of the screw has been improved. The variation of the setting screw which is connected to the tension screw by means of an angular gear, as indicated hereinbefore, is also applicable as far as the present arrangement is concerned. It is also possible to consider and apply other types of combination tools directed straight or obliquely outwardly from the cover and those mentioned should not be considered as limiting with regard to the inventive idea which is, moreover, defined in the subsequent claims.

I claim:

1. A tension arrangement at the saw sword (15) of a chain saw in which the sword is secured with at least one sword bolt (11) to the saw body (12) and is displaceable in its longitudinal direction by means of a tension screw (24) extending in the same longitudinal direction, said screw being journaled in bearings on a clutch cover (10) connected to said saw body, means defining as elongated groove (17) on said saw body, a cavity (18) on said saw body in alignment with said groove, a pin (19) movable along said groove and said cavity and extending through and fixed to said sword, said pin having an end portion protruding at the opposite side of the said sword for engagement with threads (27) on said tension screw so that rotation of said tension screw produces relative movement between said sword and said saw body.

2. A tension arrangement as set forth in claim 1, wherein said pin (19) has a foot (20) positioned within set cavity.

3. A tension arrangement as set forth in claim 2, wherein said means defining an elongated groove is a separate plate (16) overlying said cavity, said plate also retaining said foot in said cavity.

4. A tension arrangement as set forth in claim 1, including means (28, 30) preventing rotation of said tension screw in other direction whereby said screw is rotatable only in a direction to increase tension.

5. A tension arrangement as set forth in claim 1, including a flexible shaft (31) connected to said tension screw and extending to the exterior of said clutch housing to receive a tool for rotating said tension screw.

* * * * *